US005645020A

United States Patent [19]

Yamada

[11] Patent Number: 5,645,020

[45] Date of Patent: Jul. 8, 1997

[54] CAM ASSEMBLY INSTALLATION IN ENGINE

[75] Inventor: Yoshihiko Yamada, Komae, Japan

[73] Assignee: Unisia Jecs Corporation, Atsugi, Japan

[21] Appl. No.: 609,441

[22] Filed: Mar. 1, 1996

[30] Foreign Application Priority Data

Mar. 3, 1995 [JP] Japan ..... 7-043897

[51] Int. Cl.[6] ..... F01L 13/00

[52] U.S. Cl. ..... 123/90.17; 123/90.31; 123/90.27

[58] Field of Search ..... 123/90.15, 90.16, 123/90.17, 90.27, 90.31, 90.6, 193.5, 193.3; 74/567, 568 R

[56] References Cited

U.S. PATENT DOCUMENTS 5,333,579 8/1994 Hara et al. ..... 123/90.17
5,365,896 11/1994 Hara et al. ..... 123/90.17
5,494,009 2/1996 Yamada et al. ..... 123/90.17
5,501,186 3/1996 Hara et al. ..... 123/90.17

FOREIGN PATENT DOCUMENTS 43 20 126 12/1993 Germany .
2 268 246 1/1994 United Kingdom .
2 268 570 1/1994 United Kingdom .

*Primary Examiner*—Weilun Lo
*Attorney, Agent, or Firm*—Foley & Lardner

[57] ABSTRACT

A control member holder on cam brackets keeps a control member rotatable on the cam brackets, while a control cam holder on supports keeps control cams fixed to the control member cooperating with the supports in such a manner as to cause the supports to move in a plane perpendicular to a shaft axis of a driving shaft to vary eccentricity of intermediate members rotatably supported by the suppports as the control member rotates.

17 Claims, 5 Drawing Sheets

CAM ASSEMBLY INSTALLATION IN ENGINE

BACKGROUND OF THE INVENTION

The present invention relates to an installation of cams on a cylinder head in an internal combustion engine.

U.S. Pat. No. 5,365,896, equivalent to GB-B 2 268 246 or DE-A 43 20 126, discloses a device for moving a plurality of hollow cams relative to its driving shaft. This known device comprises a plurality of drive members rotatable with the driving shaft and a plurality of intermediate members rotatable within a plurality of supports, respectively. The driving shaft extends through central openings in the intermediate members. Each of the central openings is dimensioned to allow limited movement of one of the supports to vary eccentricity of an axis of the intermediate members with respect to the shaft axis. The hollow cams are coaxial with the driving shaft and rotatable relative thereto. Each of the drive members is coupled with the adjacent one of the intermediate members by a first coupling at a first position spaced from the shaft axis. Each of the hollow cams is coupled with the adjacent one of the intermediate members by a second coupling at a second position angularly spaced from the first position with respect to the shaft axis. Each of the first and second couplings has a movable connection with the adjacent one of the intermediate members to permit variation in its distance from the axis of the intermediate member during operation. To move the supports within a plane perpendicular to the shaft axis, a control member extends through holes of the supports with its control cams fit in the holes, respectively. In installing this known device on a cylinder head, it is mounted to a framing structure and the assembly including the framing structure is placed on the cylinder head and bolts are tightened to fixedly secure the framing structure to the cylinder head.

An object of the present invention is to provide an installation of cam assembly of the above kind without such a framing structure which is bulcky in construction and expensive in manufacture.

SUMMARY OF THE INVENTION

According to the present invention. there is provided an installation in an internal combustion engine comprising:

a cylinder head;

a plurality of hollow cams;

a driving shaft extending through said plurality of hollow cams and rotatable about a shaft axis;

a plurality of drive members rotatable with said driving shaft;

a plurality of supports;

a plurality of intermediate members supported in said plurality of supports, respectively. for rotation about an axis thereof so as to rotate eccentrically with respect to said shaft axis;

each of said plurality of drive members being coupled with the adjacent one of said plurality of intermediate members by a first coupling at a first position spaced from said shaft axis, each of said plurality of hollow cams being coupled with the adjacent one of said plurality of intermediate members by a second coupling at a second position angularly spaced from said first position with respect to said shaft axis, each of said first and second couplings having a movable connection with the adjacent one of said plurality of intermediate members to permit variation in its distance from said axis of said intermediate member during operation, a plurality of brackets fixedly secured to said cylinder head to rotatably support said plurality of hollow cams on said cylinder head;

a control member rotatable about an axis thereof and having a plurality of control cams arranged distant one after another along said axis of said control member;

each of said plurality of brackets being formed with a recess supporting said control member;

a control member holder on said plurality of brackets to keep said control member rotatable on said plurality of brackets;

each of said plurality of supports being formed with a recess supporting the adjacent one of said plurality of control cams; and a control cam holder on said plurality of supports to keep said control cams operatively cooperating with said plurality of supports in such a manner as to cause said plurality of supports to move in a plane perpendicular to said shaft axis to vary the eccentricity of said intermediate members.

BRIEF DESCRIPTION OF THE DRAWINGS

FIG. 6 is an enlarged end view of a bracket which a supporting axle is fixedly secured to;

DETAILED DESCRIPTION OF THE INVENTION

Figure 1:
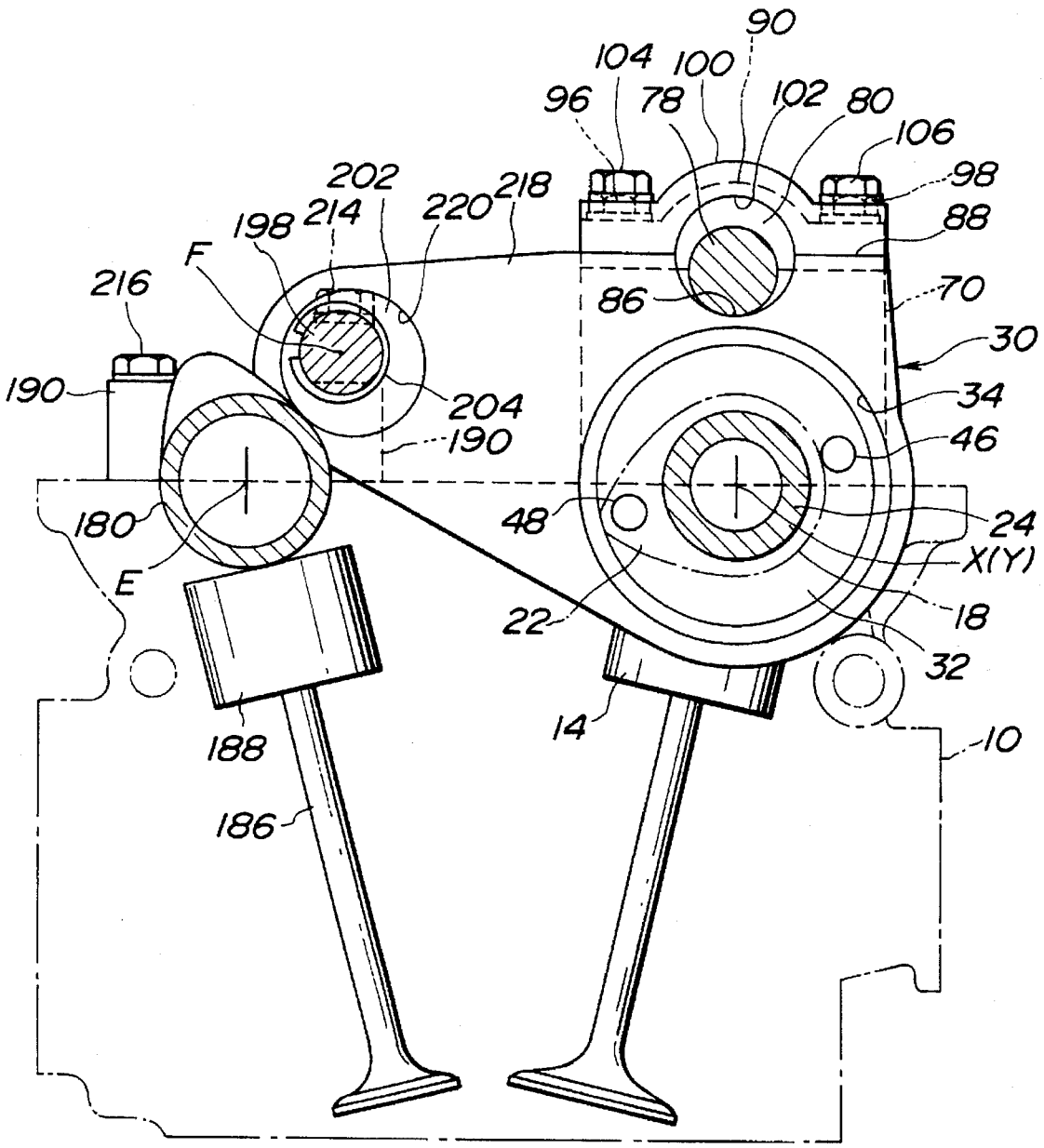
FIG. 1 is an enlarged cross section, taken through the line A—A in FIG. 2.
Figure 2:
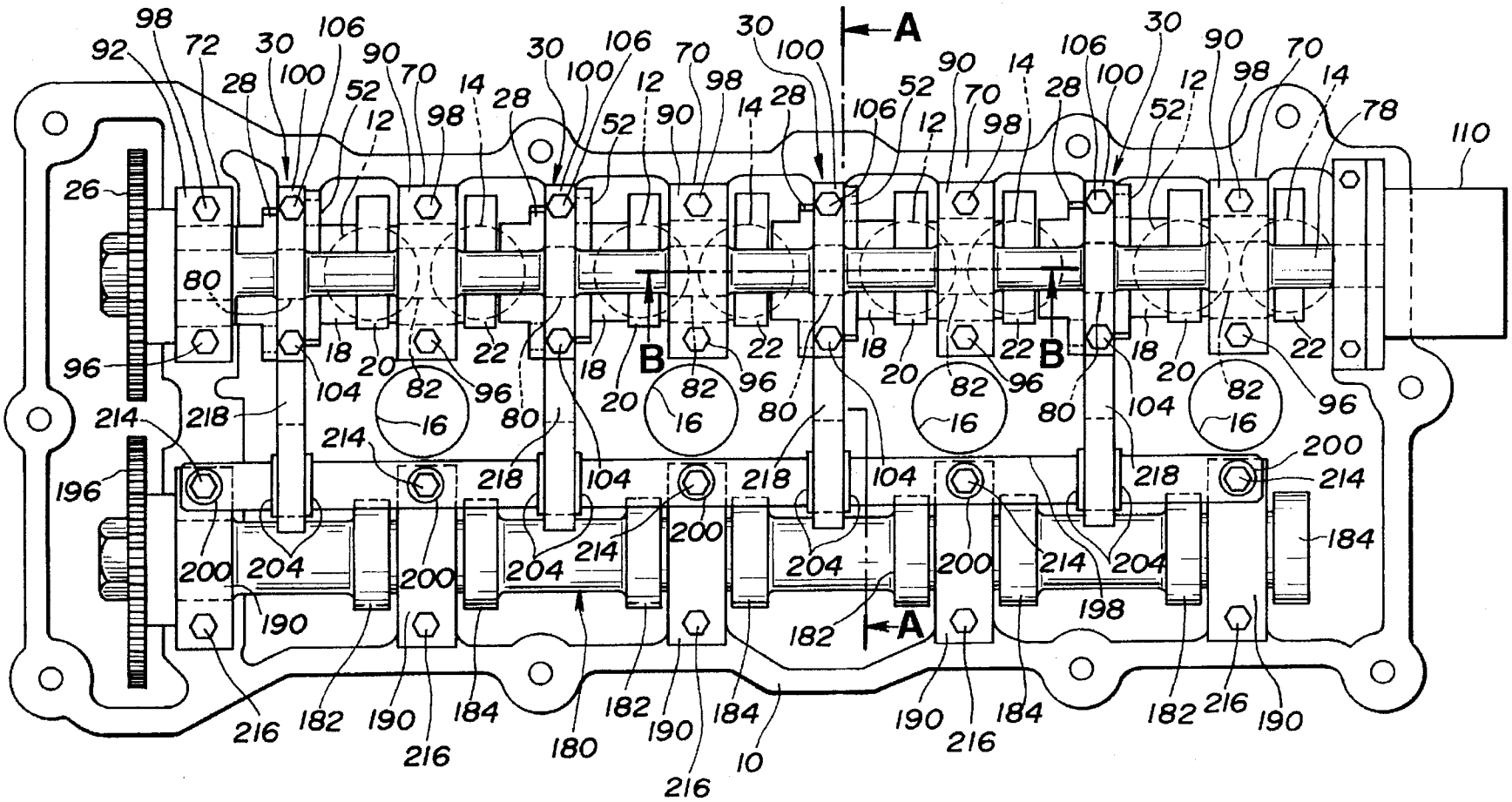
FIG. 2 is a plan view of a cylinder head of an internal combustion engine.

Referring to FIGS. 1 and 2, there is shown a dual-overhead camshaft, 16-valve, inline four cylinder engine with a cylinder head cover removed.

In FIG. 2, a cylinder head 10 is illustrated by the fully drawn line, while it is illustrated by the one-dot chain line in FIG. 1. For each of four cylinders, four cylinder valves are arranged totaling sixteen valves. They can be divided into a first group of eight cylinder valves and a second group of eight cylinder valves. The eight cylinder valves belonging to the first group have valve lifters arranged in line, while the eight cylinder valves belonging to the second group have valve lifters arranged in line. In FIG. 2, inline eight broken line circles 12 and 14 illustrate the valve lifters of the cylinder valves belonging to the first group, and the fully drawn four ciricles 16 illustrate spark plug holes. Although not shown in FIG. 2, the valve lifters of the cylinder valves belonging to the second group are arranged in line. The valve lifters 12 and 14 belonging to the first group and the valve lifters belonging to the second group are arranged in parallel.

A plurality of, four in this embodiment, hollow cams 18, each having two spaced cam lobes 20 and 22, controls the valve lifters 12 and 14 such that, viewing in FIG. 2, the leftmost one of the hollow cams 18 has its cam lobes 20 and 22 kept in cooperation with the leftmost one and the next adjacent valve lifters 12 and 14, respectively, one hollow cam 18 disposed next to the leftmost one has its cam lobes 20 and 22 kept in cooperation with the next two valve lifters 12 and 14, respectively, one hollow cam 18 following the next has its cam lobes 20 and 22 kept in cooperation with two valve lifters 12 and 14 following the next two, and the rightmost hollow cam 18 has its cam lobes 20 and 22 kept in cooperation with the next adjacent the rightmost valve lifter and the rightmost valve lifter 12 and 14, respectively.

Figure 3:
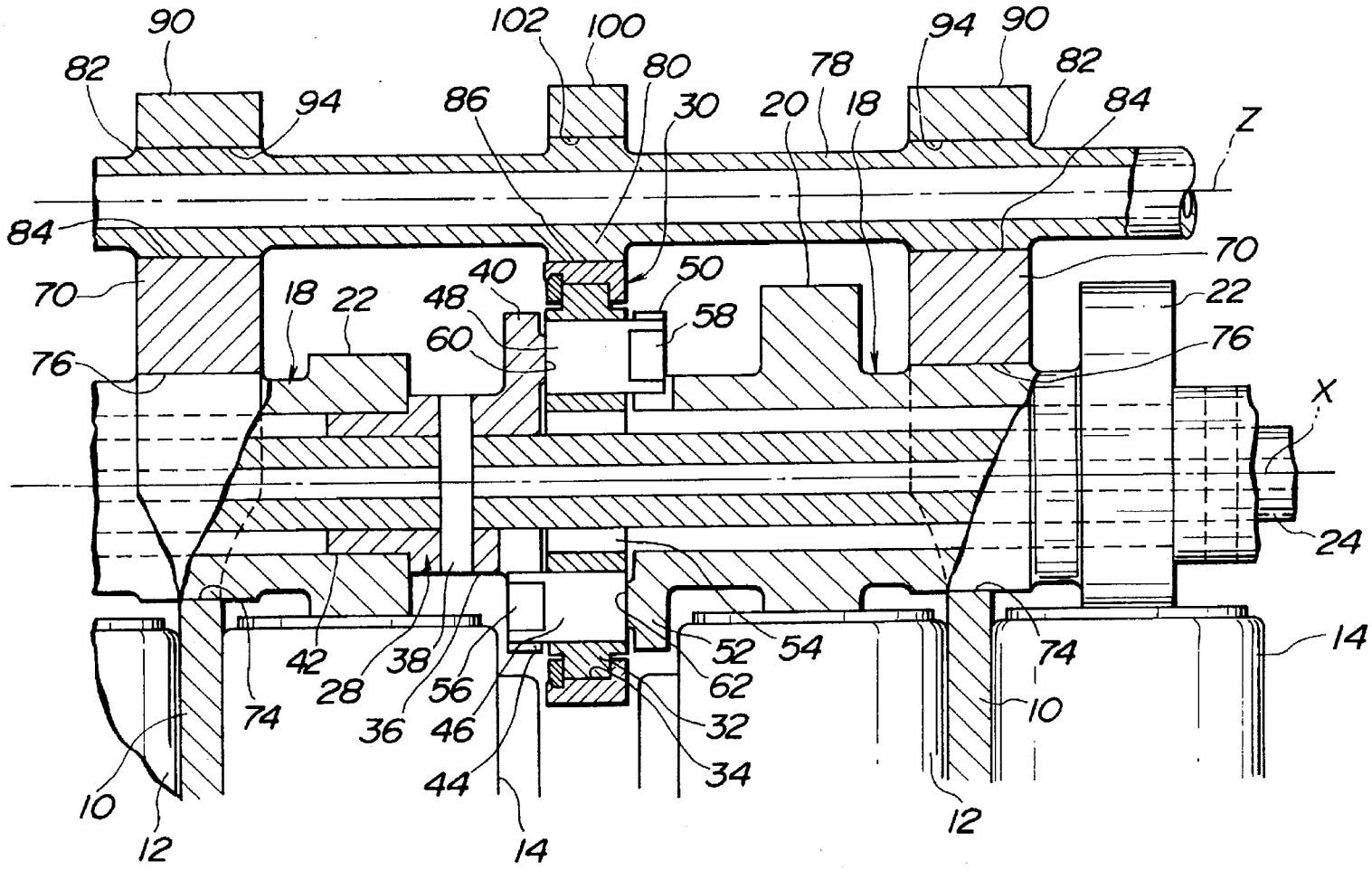
FIG. 3 is an enlarged fragmentary view of FIG. 2 partly broken away to show a longitudinal section taken through the line B—B in FIG. 2.
Figure 4:
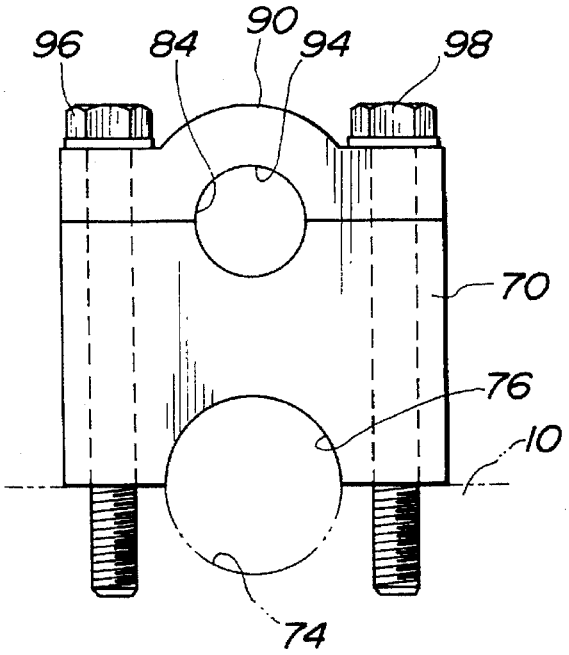
FIG. 4 is an end view of a bracket with a control member holder thereon.
Figure 5:
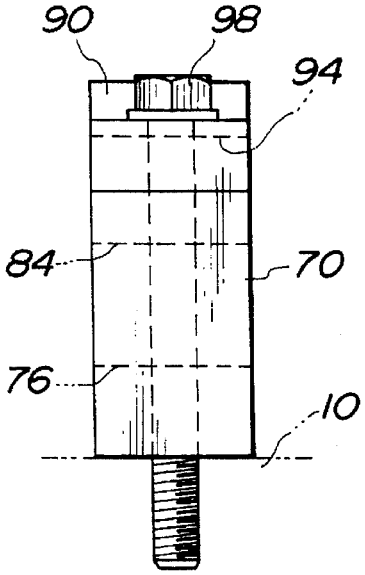
FIG. 5 is a side view of the bracket shown in FIG. 4.

As best seen in FIG. 3, a driving shaft 24 which is hollowed extends through the hollow cams 18 and is rotatable about a shaft axis X by a wheel 26 (see FIG. 2).

A plurality of, four in this embodiment, drive members 28 are rotatable with the driving shaft 24 and arranged to drive the hollow cams 18, respectively. There are a plurality of, four in this embodiment, supports 30, each supporting one of a plurality of, four in this embodiment, intermediate members 32 for rotation about an axis Y thereof.

As best seen in FIG. 1, each of the supports 30 defines a bearing or bearing surface 34 which rotatably supports one of the intermediate members 32. Viewing in FIG. 1, each of the intermediate members 32 is in the form of an annular disc and it may be called as an annular disc or disc in the following description. Since the supports 30 house the annular discs 32, respectively, they may be called as a disc housing in the following description.

Referring to FIG. 3, each of the drive members 28 includes a sleeve 36 coupled with the driving shaft 24 and fixed thereto for unitary rotation owing to a cotter pin 38 passing through the sleeve 36 and the driving shaft 24 diametrically. The sleeve 36 of each drive member 28 has an integral drive collar 40 extending radially outwardly from one end thereof. At a portion adjacent the opposite end, the sleeve 36 of at least some of the drive members 28 may, if desired, be reduced in diameter to form a cylindrical bearing surface 42 in rolling contact with the inner peripheral wall of the adjacent hollow cam 18 for assuring smooth relative angular displacement between the hollow cams 18 and the driving shaft 24 about the shaft axis X.

The drive collar 40 of each of the drive members 28 is formed with a radial slot 44 slidably engaged by a first pin 46 of the adjacent one of the annular discs 32. The first pin 46 is rotatably supported by the annular disc 32 and projects from one face of the disc 32 into the radial slot 44. Projecting from the opposite face of each of the discs 32 is a second pin 48 which is angularly displaced from the first pin 46 about the axis Y through preferrably an angle of 180 degrees. The second pin 48 is rotatably supported by the disc 32 and slidably engages a radial slot 50 with which the adjacent one of driven collars 52 is formed. The driven collars 52, forming an integral part of the hollow cams 18, respectively, are freely rotatable with the hollow cams 18 relative to the driving shaft 24.

Each of the annular discs 32 has a central hole 54 which is wide enough to allow movement of the disc 32 in a plane perpendicular to the shaft axis X without touching the surface of the driving shaft 24. The eccentricity of the disc 32 with respect to the shaft axis X can be varied by moving the disc housing 32 in the plane perpendicular to the shaft axis X. Thus, each of the discs 32 supported in the disc housings 32 for rotation about the axis Y thereof can rotate eccentrically with respect to the shaft axis X.

For good transfer of torque from each of the drive members 28 to the adjacent one of the discs 32 and then from the disc 32 to the adjacent one of the hollow cams 18, the first pin 46 has an end portion defined by two opposite flat faces 56 slidably engaging the radial slot 44 defining walls and the second pin 48 has an end portion defined by two flat faces 58 slidably engaging the radial slot 50 defining walls.

Each of the drive members 28 is coupled with the adjacent one of the annular discs 32 by a first coupling, which includes the drive collar 40 and the first pin 46, at a first position spaced from the shaft axis X. Each of the hollow cams 18 is coupled with the adjacent one of the disc 32 by a second coupling, which includes the driven collar 52 and the second pin 48, at a second position spaced from the shaft axis X. During operation, each of the first and second couplings has a movable connection with the adjacent one of the annular discs 32 to permit variation in its distance from the axis Y. Assuming that there is no eccentricity and thus the annular discs 32 rotate concentrically with respect to the driving shaft 24, the distance, from the axis Y, of the connection which each of the first and second couplings has with the adjacent one of the annular discs 32 does not vary during operation. If there is the eccentricity and thus the annular discs 32 rotate eccentrically with respect to the shaft axis X, the distance of the connection from the axis Y varies.

For permitting smooth movement of each of the annular discs 32 relative to the adjacent drive and driven collars 40 and 52, each of the drive collars 40 has a protrusion 60 in abutting engegement with the adjacent face of the annular disc 32 and the axial end of the second pin 48, while each of the driven collars 52 has a similar protrusion 62 in abutting engagement with the adjacent face of the annular disc 32 and the axial end of the first pin 46. Each of the protrusions 60 and 62 extends in circumferential direction of the drive and driven collars 40 and 52, respectively, except the portions where the radial slots 44 and 50 are cut.

Referring to FIGS. 2, 3, 4 and 5, a plurality of, four in this embodiment, cam brackets 70 rotatably support journals of the hollow cams 18, respectively, and an end bracket 72 rotatably supports an end journal of the driving shaft 24. As is readily seen from FIGS. 3 and 4, the journal of each of the hollow cams 18 is supported by one of semi-cylindrical bearing recesses 74 with which structures between the valve lifter guide holes of the cylinder head 10 are formed and by the mating semi-cylindrical bearing recess 76 with which each of the cam brackets 70 is formed. Viewing in FIGS. 4 and 5, the semi-cylindrical bearing recess 76 is recessed from the bottom of each of the cam brackets 70. The end bracket 72 is substantially the same, in construction, as the cam brackets 70 except that the end bracket 72 rotatably supports the end jorunal of the driving shaft 24 rather than the journal of the adjacent hollow cam 18.

All of the disc housings 30 can be moved by rotating a control member 78 about an axis Z. The control member 78 is in the form of a hollow control shaft having a plurality of, four in this embodiment, eccentric control cams 80 arranged distant one after another along the axis Z and a plurality of, five in this embodiment, journals 82. Each of the cam brackets 70 has is with a semi-cylindrical bearing recess 84 recessed from the top thereof as viewed in FIGS. 4 and 5. Among all, the journal 82 adjacent the end of the control shaft 78 is supported by the semi-cylindrical recess recessed from the top of the end bracket 72, while the other four journals 82 are supported by the semi-cylindrical recesses 84 of the cam brackets 70, respectively.

As viewed in FIG. 1, each of the disc housings 30 is formed with a semi-cylindrical recess 86 recessed from a top flat wall 88 thereof to support the adjacent one of the eccentric control cams 80.

A control member holder is placed on the cam brackets 70 and end bracket 72 to keep the control shaft 78 rotatable on the the cam brackets 70 and end bracket 72. The control member holder includes a plurality of, four in this embodiment, bearing caps 90 on the cam brackets 70, respectively, and a bearing cap 92 on the end bracket 72. As seen from FIGS. 4 and 5, each of bearing caps 90 and 92 is formed with a semi-cylindrical recess 94 partly receiving the corresponding journal 82 and fixedly secured to the associated bracket 70 or 72 by two bolts 96 and 98 used to fixedly secure the bracket 70 or 72 to the cylinder head 10.

A control cam holder is placed on the top flat walls 88 of the disc housings 30 to keep the control cams 80 operatively cooperating with the disc housings 30, respecively, in such a manner as to cause the disc housings 30 to move in a plane perpendicular to the shaft axis X to vary the eccentricity of the annular discs 32. The control cam holder includes a plurality of, four in this embodiment, control cam caps 100 on the top flat walls 88 of the disc housings 30, respectively. As seen from FIG. 1, each of the control cam caps 100 is formed with a semi-cylindrical recess 102 partly receiving the corresponding control cam 80 and fixedly secured to the associated one of the disc housings 30 by two bolts 104 and 106.

The control shaft 78 is rotatable by an actuator 110 rigidly attached to the cylinder head 10. The actuator 110 may be an electric motor such as a stepping motor or a hydraulic motor of the vane type which is hereinafter described in connection with FIG. 8.

Figure 8:
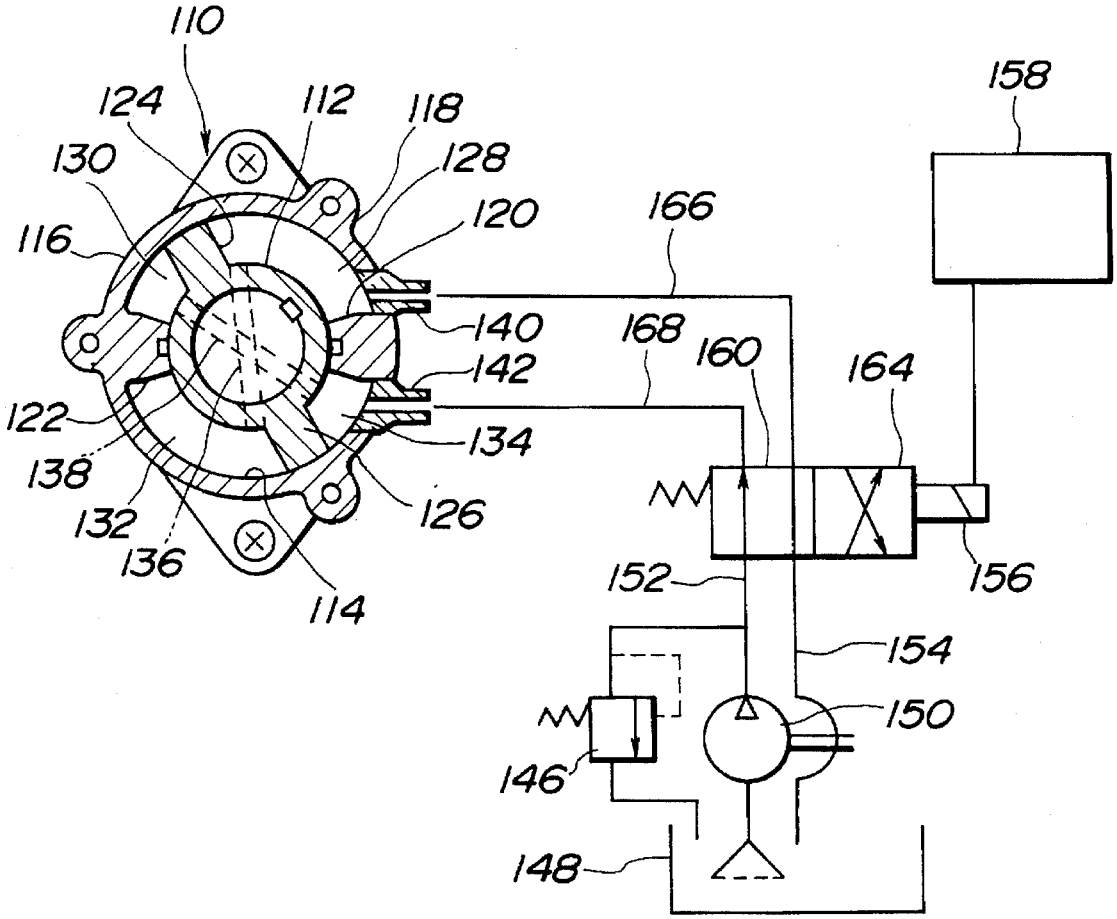
FIG. 8 is a hydraulic circuit diagram including an actuator for positioning the control member angularly about a control member axis.

Referring to FIG. 8, the control shaft 78 is drivingly coupled with a turbine 112 disposed in a cylindrical bore 114 of a housing 116. The turbine 112 includes a hub 118 rotatably supported by two partitions 120 and 122 which project inwardly toward each other and angularly spaced at an angle of 180 degrees. The turbine 112 includes two vanes 124 and 126 radially extending from the hub 118 into the cylindrical bore 114. The vane 124 cooperates with the partition 120 to define a first chamber 128 on one side thereof, while it cooperates with the partition 122 to define a second chamber 130 on the opposite side thereof. The other vane 126, on the other hand, cooperates with the partition 122 to define a third chamber 132 on one side thereof, while it cooperates with the partition 120 to define a fourth chamber 134. The hub 118 has a first radial passage 136 having one end communicating with the first chamber 128 and the opposite end communicating with the third chamber 132. A second radial passage 138, through the hub 118, has one end communicating with the second chamber 130 and the opposite end communicating with the fourth chamber 134. The actuator housing 116 has a first oil supply/discharge port 140 always communicating with the first chamber 128 and a second oil supply/discharge port 142 always communicating with the fourth chamber 134. A two-position valve 144 is fluidly disposed between the actuator 110, a pressure regulator valve 146 and a drainage 148. The pressure regulator valve 146 is supplied with oil discharged by an oil pump 150 and effects pressure regulation to generate oil under regulated pressure. This oil under regulated pressure is supplied to the two-position valve 144 through a supply line 152. A drain line 154 extends from the two-position valve 144 to the drainage 148. The two-position valve 144 is of the electromagnetically operated type including a solenoid 156 whose energization is under the control of a control unit 158. The two-position valve 144 has a spring set first position 160 which is set by a return spring 162 when the solenoid 156 is not energized. Upon energization of the solenoid 156, there is a shift to a second position 164 against the action of the return spring 162. In the second position 164, oil under pressure is supplied to the port 140 via a line 166, while oil is discharged from the port 142 through a line 168, since the supply line 152 is allowed to communicate with the line 166 and the drain line 154 is allowed to communiocate with the line 168. Under this condition, owing to pressure build-up in the first and third chambers 128 and 132, the turbine 112 is turned counter-clockwise to a first angular position, as viewed in FIG. 8. In the spring set first position 160, the supply line 152 and the drain line 154 are connected to the lines 168 and 166, respectively, so that oil under pressure is supplied to the port 142 and oil is discharged from the port 140. Since there is an increase in pressure within the fourth and second chambers 134 and 130, the turbine 112 is turned clockwise, as viewed in FIG. 8, to a second angular position. The control unit 158 receives signals indicative of the engine speed and the intake air flow rate so as to determine whether the solenoid 156 should be energized or not.

Rotating the driving shaft 24 about the shaft axis X rotates the drive members 28 with the drive collars 40. The radial slots 44 of the drive collars 40 are engaged by the first pins 46 projecting from the associated annular discs 32 and rotate the discs 32. Through the second pins 48 and the associated radial slots 50 of the driven collars 52, the discs 32 rotate the associated hollow cams 18 which control the associated valve lifters 12 and 14. If the axis Y of the discs 32 coincides with the shaft axis X of the driving shaft 24, there is no difference in angular velocity between the driving shaft 24 and the hollow cams 18. The second pins 48 of the discs 32, therefore, cause the associated hollow cams 18 to rotate at the same angular velocity as the driving shaft 24.

Let us now assume that each of the discs 32 is moved down viewing in FIG. 3, thus producing an eccentricity between the disc 32 and the driving shaft 24. If the driving shaft 24 rotates at a constant speed, the angular velocity of the disc 32 will no longer be equal to that of the driving shaft 24, but, in the angular position shown in FIG. 3, will be higher than that of the driving shaft 24. In other words, the disc 32 is at the end of an acceleration phase which has increased its angular velocity to a value higher than the angular velocity of the driving shaft 24.

When the mechanism is rotated through 180 degrees, the opposite situation occurs, i.e., the angular velocity of the disc 32 will be lower than that of the driving shaft 24. In other words, the disc 32 is at the end of a deceleration phase which has reduced its angular velocity to a value lower than the angular velocity of the driving shaft 24.

It is apparent from the above that there will be a moment in between the two situations described in which the angular velocity of the disc 32 is equal to the angular velocity of the driving shaft 24. This moment will occur whenever the radial plane including the axis Y of the disc 32 and the first and second pins 46 and 48 is approximately perpendicular to the plane of the drawing FIG. 3.

If now, in FIG. 3, the disc housing 30 is tilted about an axis parallel to the shaft axis X of the driving shaft 24, the phase angle or angular of the eccentricity will be changed.

Therefore, according to this mechanism, the hollow cams 18 can be moved at varying speeds, using the motion of the driving shaft 24 rotating at a constant speed. This speed variation can be regulated both in amplitue and phase by adjusting the magnitude and angular direction of eccentricity.

Referring again to FIGS. 1 and 2, there is mounted on the cylinder head 10 a hollow camshaft 180 lying in parallel to the driving shaft 24. The camshaft 180 has a plurality of, four in this embodiment, pairs of cam lobes 182 and 184 which control the valve lifters of the cylinder valves belonging to the second group, only one cylinder valve and its valve lifter being shown at 186 and 188 in FIG. 1. In addition to an end journal, the camshaft 180 has four journals, each being disposed between two cam lobes 182 and 184 of each pair. A plurality of, five in this embodiment, cam brackets 190 rotatably support the journals of the camshaft 180, respectively. As is readily seen from FIGS. 6 and 7, each of the journals of the camshaft 180 is supported by one of semi-cylindrical bearing recesses 192 with which the structures between the valve lifter guide holes of the cylinder head 10 is formed and by the mating semi-cylindrical recess 194 with which the associated one of the cam brackets 190 is formed.

The camshaft 180 is rotatable about an axis E thereof by a wheel 196 (see FIG. 2).

As shown in FIG. 1, according to this embodiment, all of the disc housings 30 tilt about and move radially with respect to a predetermined axis F which is parallel to the shaft axis X of the driving shaft 24. More specifically, this predetermined axis F is distant from the shaft axis X further than the each of the first pin 46 is.

The predetermined axis E coincides with the center of axle 198 in the form of a rod. The rod 198 has a circular cross section over the whole length except portions where a plurality of, five in this embodiment, joints 200 are formed. A plurality of, four in this embodiment, eccentric collars 202 are rotatably coupled with the rod 198 to tilt about the predetermined axis F. As shown in FIG. 2, the eccentric collars 202 and the joints 200 are arranged such that each of the eccentric collars 202 is disposed between the adjacent two of the joints 200. As is seen from FIG. 1, each of the eccentric collars 202 is held in its appropriate position by snap rings 202 coupled with the rod 198. At the joints 200, the rod 198 rests on the cam brackets 190.

Figure 6:
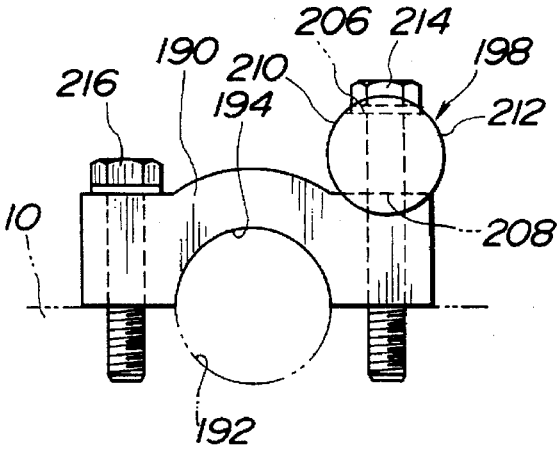
Figure 7:
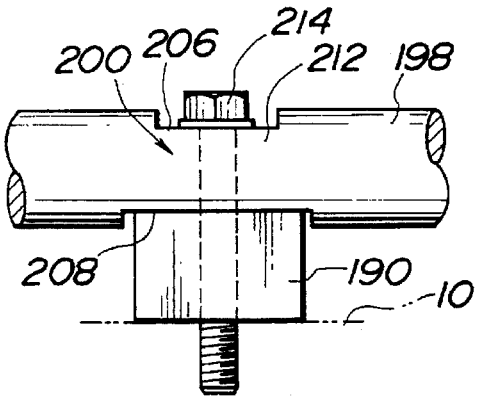
FIG. 7 is a side view of the bracket shown in FIG. 6.

As best seen in FIGS. 6 and 7. each of the joints 200 is defined by upper and lower flat walls 206 and 208 which are spaced and interconnected by two cylindrical walls 210 and 212. With a relatively longer bolt 214. each of the joints 200 is secured to the associated one of the cam brackets 190 which is secured to the cylinder head 10 by this bolt 214 and a relatively shorter bolt 216.

Referring to FIG. 1 and 2. a plurality of, four in this embodiment, arm portions 218 form an integral part of the plurality of disc housings 30, respectively. The arm portions 218 are operatively coupled with the eccentric collars 202, respectively, to permit the disc housings 30 to tilt about and move radially with respect to the predetermined axis F. Each of the arm portions 218 is formed with a hole 220 rotatably receiving the adjacent one of the eccentric collars 202.

In assembly, a sub-assembly including the driving shaft 24, drive members 28, disc housings 30 and hollow cams 18, eccentric collars 202 and rod 198 is placed on the cylinder head 10 with the joints 200 on the brackets 190, respectively. Then, the brackets 70 and 72 are placed on the cylinder head 10 to hold the sub-assembly on the cylinder head 10. The control shaft 78 is mounted with its journals 82 fit in the semi-cylindrical upper recesses 84 of the brackets 70, 72, respectively, and its eccentric control cams 80 fit in the semi-cylindrical recesses 86 of the disc housings 30, respectively. The bearing caps 90, 92 are placed on the brackets 70, 72, respectively, and the control cam caps 100 are placed on the disc housings 30, respectively. The bolts 214, 96, 98, 104 and 106 are tightened to fixedly secure the rod 198 to brackets 190, fixedly secure the bearing caps 90, 92 to the brackets 70, 72, respectively and fixedly secure the control cam caps to the disc housings 30, respectively.

In FIG. 2, the cylinder valves belonging to the first group may be intake or exhaust valves and the cylinder valves belonging to the second group are exhaust valves if the cylinder valves belonging to the first group are intake valves or intake valves if the cylinder valves belonging to the first group are exhaust valves.

What is claimed is:

1. An installation in an internal combustion engine comprising:

a cylinder head;

a plurality of hollow cams;

a driving shaft extending through said plurality of hollow cams and rotatable about a shaft axis;

a plurality of drive members rotatable with said driving shaft;

a plurality of supports;

a plurality of intermediate members supported in said plurality of supports, respectively, for rotation about an axis thereof so as to rotate eccentrically with respect to said shaft axis;

each of said plurality of drive members being coupled with the adjacent one of said plurality of intermediate members by a first coupling at a first position spaced from said shaft axis, each of said plurality of hollow cams being coupled with the adjacent one of said plurality of intermediate members by a second coupling at a second position angularly spaced from said first position with respect to said shaft axis, each of said first and second couplings having a movable connection with the adjacent one of said plurality of intermediate members to permit variation in its distance from said axis of said intermediate member during operation, a plurality of brackets fixedly secured to said cylinder head to rotatably support said plurality of hollow cams on said cylinder head;

a control member rotatable about an axis thereof and having a plurality of control cams arranged distant one after another along said axis of said control member;

each of said plurality of brackets being formed with a recess supporting said control member;

a control member holder on said plurality of brackets to keep said control member rotatable on said plurality of brackets;

each of said plurality of supports being formed with a recess supporting the adjacent one of said plurality of control cams; and a control cam holder on said plurality of supports to keep said control cams operatively cooperating with said plurality of supports in such a manner as to cause said plurality of supports to move in a plane perpendicular to said shaft axis to vary the eccentricity of said intermediate members.

2. An installation as claimed in claim 1, wherein said control member holder includes a plurality of bearing caps fixedly secured to said plurality of brackets, respectively.

3. An installation as claimed in claim 1, wherein said control cam holder includes a plurality of control cam caps fixedly secured to said plurality of supports, respectively.

4. An installation as claimed in claim 2, wherein said control cam holder includes a plurality of control cam caps fixedly secured to said plurality of supports, respectively.

5. An installation as claimed in claim 1, wherein said control member is in the form of a control shaft.

6. An installation as claimed in clasim 5, further comprising an actuator fixedly mounted on said cylinder head and coupled with said control shaft.

7. An installation as claimed in claim 1, wherein each of said control cams is an eccentric cam which tilts about said axis of said control member as said control member rotates about said axis thereof to cause the associated one of said supports to tilt about and move radially with respect to an axis parallel to said shaft axis of said driving shaft.

8. An installation as claimed in claim 7, wherein said axis which said supports tilt about and radially move with respect to is distant from said shaft axis of said driving shaft further than said first pins are.

9. An installation as claimed in claim 1, wherein each of said control cams is an eccentric cam so as to tilt about said axis of said control member as said control member rotates about said axis thereof.

10. An installation as claimed in claim 9, further comprising:

means for permitting said plurality of supports to tilt about and move radially with respect to a predetermined axis which is parallel to and distant from said shaft axis of said driving shaft further than said first pins are.

11. An installation as claimed in claim 10, wherein said supports permitting means include:

an axle fixedly mounted on said cylinder head;

a plurality of eccentric collars rotatably coupled with said axle so as to tilt about said predetermined axis; and a plurality of arm portions integral with said plurality of supports, respectively, each of said plurality of arm portions is formed with a hole rotatably receiving the adjacent one of said plurality of eccentric collars.

12. An installation as claimed in claim 10, further comprising:

a camshaft lying in parallel to said driving shaft and rotatable about a camshaft axis thereof;

a plurality of second brackets fixedly secured to said cylinder head to keep said camshaft rotatable about said camshaft axis thereof;

an axle fixedly secured to said plurality of second brackets;

a plurality of eccentric collars rotatably coupled with said axle so as to tilt about a predetermined axis parallel to said shaft axis of said driving shaft, said plurality of supports including a plurality of arm portions, respectively, said plurality of arm portions being operatively coupled with said plurality of eccentric collars, respectively, to permit said plurality of supports to tilt about and move radially with respect to said predetermined axis.

13. An installation as claimed in claim 12, wherein each of said plurality of arm portions is formed with a hole rotatably receiving the associated one of said plurality of eccentric collars.

14. An installation as claimed in claim 12, wherein each of said plurality of first couplings comprises:

a drive collar, having a first radial slot, rotatable with the adjacent one of said plurality of drive members about said shaft axis; and a first pin having one end rotatably supported by the adjacent one of said plurality of intermediate members and an other end slidably engaged in said first radial slot of said drive collar, and wherein each of said plurality of second couplings comprises:

a driven collar, having a second radial slot, rotatable with the adjacent one of said plurality of hollow cams; and a second pin having one end rotatably supported by the adjacent one of said plurality of intermediate members and an other end slidably engaged in said second radial slot.

15. An installation as claimed in claim 12, wherein said axle has a plurality of joints at which said axle rests on said plurality of second brackets.

16. An installation as claimed in claim 15, wherein said plurality of joints are secured to said plurality of second brackets, respectively, by a plurality of bolts threadedly engaged in said cylinder head.

17. An installation as claimed in claim 12, wherein said plurality of eccentric collars and said plurality of joints are arranged such that each of said plurality of eccentric collars is disposed between the adjacent two of said plurality of joints.

* * * * *